US011635264B2

(12) United States Patent
Phillips et al.

(10) Patent No.: US 11,635,264 B2
(45) Date of Patent: Apr. 25, 2023

(54) HEAT EXCHANGER ASSEMBLY

(71) Applicant: Carrier Corporation, Palm Beach Gardens, FL (US)

(72) Inventors: Charlie Christensen Phillips, Indianapolis, IN (US); Jorge A. Solis Chavez, Carmel, IN (US); Fred V. Pouyi Mamona, Indianapolis, IN (US)

(73) Assignee: Carrier Corporation, Palm Beach Gardens, FL (US)

( * ) Notice: Subject to any disclaimer, the term of this patent is extended or adjusted under 35 U.S.C. 154(b) by 194 days.

(21) Appl. No.: 16/949,111

(22) Filed: Oct. 14, 2020

(65) Prior Publication Data

US 2021/0140724 A1 May 13, 2021

Related U.S. Application Data

(60) Provisional application No. 62/934,813, filed on Nov. 13, 2019.

(51) Int. Cl.
*F28F 9/00* (2006.01)

(52) U.S. Cl.
CPC ..... *F28F 9/002* (2013.01)

(58) Field of Classification Search
CPC ..... F28F 9/001; F28F 9/002; F28F 2009/004; F28F 2275/14; F28F 2280/00; F28F 2280/06; F28F 2280/10; F24F 1/0063; F24F 1/0323; F24F 1/16; F24F 13/30
See application file for complete search history.

(56) References Cited

U.S. PATENT DOCUMENTS

| | | | | |
|---|---|---|---|---|
| 4,138,969 | A * | 2/1979 | Thompson | F28F 11/00 122/421 |
| 6,688,712 | B2 * | 2/2004 | Adams | E04B 1/3483 312/257.1 |
| 8,944,397 | B2 | 2/2015 | Brown | |
| 10,234,215 | B2 | 3/2019 | Rong | |
| 2005/0034471 | A1 * | 2/2005 | Shin | F24F 13/222 62/288 |
| 2015/0111488 | A1 * | 4/2015 | Son | F24F 13/20 454/329 |
| 2017/0130974 | A1 | 5/2017 | Mercer et al. | |
| 2018/0142908 | A1 | 5/2018 | Morikawa et al. | |
| 2019/0128614 | A1 * | 5/2019 | Bultot | F28B 1/06 |
| 2019/0162476 | A1 * | 5/2019 | Wallet-Laily | F28F 17/005 |
| 2019/0277517 | A1 | 9/2019 | Nanjappa et al. | |
| 2019/0310020 | A1 * | 10/2019 | Klaba | F28B 1/06 |

* cited by examiner

*Primary Examiner* — Travis Ruby
*Assistant Examiner* — Christopher C Pillow
(74) *Attorney, Agent, or Firm* — Souad Hakim

(57) ABSTRACT

A heat exchanger mounting assembly for use in an HVAC system includes a frame for mounting a heat exchanger operably coupled to at least two sides of a heat exchanger housing, the frame having at least two mounting rails, each mounting rail having a first mounting rail side, and second mounting rail side, a proximate end and a distal end; and at least two coil support members extending from the first mounting rail side; and at least one connection member located on the second mounting rail side; and at least one support rail configured to engage the second mounting rail side of the at least two mounting rails; and at least two cross rails operably coupled to each of the at least two coil support members; and a heat exchanger, comprising at least one coil header operably coupled to at least two coil support members.

18 Claims, 6 Drawing Sheets

HEAT EXCHANGER ASSEMBLY

CROSS REFERENCE TO A RELATED APPLICATION

The application claims the benefit of U.S. Provisional Application No. 62/934,813 filed Nov. 13, 2019, the contents of which is hereby incorporated in its entirety.

BACKGROUND

The subject matter disclosed herein relates generally to support systems for mounting heating, ventilation, and air conditioning (HVAC) components. In particular, a heat exchanger mounting assembly for use in a residential HVAC system.

Heat exchangers used in residential heating and air conditioning systems are available in a range of coil configurations, commonly A-coil or N-coil, so named for the distinctive shape the coil makes when installed within a heat exchanger housing. For instance, in either an A-coil or N-coil heat exchanger, at least two sides of a coil are configured to form an apex and two heat exchange headers form a base which is typically screwed, bolted or otherwise fixedly attached to a foundation, or base plate such as a condensate tray, within a housing. When a heat exchanger is fixed in place within a housing in this manner, servicing, removal or replacement of a heat exchanger is a difficult and time consuming task that is likely to result in increased consumer costs.

Heat exchangers having a similar shape (e.g., "A" or "N"), may not necessarily have similar dimensions (i.e., height, width, depth). For example, if a new, replacement heat exchanger is taller or wider than an existing heat exchanger, the change-out may also require replacement of an existing housing. The added cost of purchasing a new housing is likely to increase consumer costs. Changing the way in which a heat exchanger is mounted to a housing can provide for easier installation and servicing, and the option to use an existing housing, can result in consumer savings by reducing service time and equipment replacement costs.

What is needed then, is an improved device for mounting a heat exchanger within a heat exchanger housing, such that it is easier and more economical to service, remove and replace. Examples of a new and useful heat exchanger assembly relevant to the needs existing in the field are discussed below.

BRIEF DESCRIPTION

According to one non-limiting embodiment, a heat exchanger assembly, including a frame for mounting a heat exchanger operably coupled to at least two sides of a heat exchanger housing, the frame having at least two mounting rails, each mounting rail having a first mounting rail side, and second mounting rail side, a proximate end and a distal end; and at least two coil support members extending from the first mounting rail side; and at least one connection member located on the second mounting rail side; and at least one support rail configured to engage the second mounting rail side of the at least two mounting rails; and at least two cross rails operably coupled to each of the at least two coil support members; and a heat exchanger, comprising at least one coil header, wherein the at least one coil header is operably coupled to at least two coil support members and to at least two cross members.

In addition to one or more of the features described above, or as an alternative, in further embodiments, the heat exchanger assembly is contained within a heat exchanger housing having at least two interior parallel walls for mounting a heat exchanger assembly. By way of example and not limitation, a heat exchanger having an "A" shape may be inverted such that the heat exchanger resembles a "V" shape in the housing. However, it is well understood that the heat exchanger assembly may be mounted on any two interior parallel walls. In a non-limiting embodiment, a heat exchanger assembly may be mounted to any two interior parallel walls by means of one or more fasteners or fastener assembly(ies). Fasteners such as pan head or flat head screws may be used to secure the frame to the heat exchanger housing; however, in other embodiments, other types of fasteners or securement techniques may be employed. For instance, in other embodiments, rivets or other types of screws may be used. In other non-limiting embodiments, the frame may be attached to the heat exchanger housing via welding.

In addition to one or more of the features described above, or as an alternative, in further embodiments, at least one mounting rail and at least one support rail operably coupled thereto, are movably adjustable such that the mounting rail and at least one support rail may be mounted in any position or moved in any direction; by way of example and not limitation, vertically upward or downward or horizontally forward or backward, on or along the interior wall surface of a heat exchanger housing. This feature allows for the mounting of a heat exchanger of varying height within a housing. In another non-limiting example, a mounting rail and operably coupled support rail may be secured to a heat exchanger housing by means of one or more fasteners, such that the mounting rail and support rail may be moved or adjusted so as to allow the heat exchanger to be positioned at a desired location within the housing. In yet another non-limiting, at least one mounting rail operably coupled to at least one support rail may be fastened at a higher or lower vertical height within a housing to accommodate the height dimensions of a heat exchanger.

In addition to one or more of the features described above, or as an alternative, in further embodiments, at least one mounting rail and at least one coil header form a seal preventing air from bypassing the heat exchanger coil, thereby improving overall heat exchanger efficiency.

In addition to one or more of the features described above, or as an alternative, in further embodiments, one or more of the frame mounting rails, the frame support rails or the frame cross rails and coil headers have low thermal conductivity properties providing a thermal break between the frame and header coils to prevent or reduce heat transfer. By way of example and not limitation, one or more of the rails may be manufactured from materials having low thermal conductivity, such as plastic. In another example, without limitation, one or more of the rails and coil may have a thermal barrier coating.

In addition to one or more of the features described above, or as an alternative, in further embodiments, at least one support rail includes an upwardly open channel along its horizontal length for receiving at least one mounting rail. In yet another embodiment, the mounting rail and support rail have one or more means for joining, securing or interlocking to prevent the rails from separating, detaching or dislodging. By way of example and not limitation, the support rail may have a flange extending over the topmost portion of the mounting rail; the support rail channel may have inward facing lips for receiving a mounting rail having a complimentary shape; the distal and proximal ends of each of the mounting rails and support rails having a system for joining the rails, for example by means of a fastener; the support rails and mounting rails may use a snap-fit or press fit means for joining the mounting rails to the support rails.

In addition to one or more of the features described above, or as an alternative, in further embodiments, the support rail having a track along the interior bottom portion of the support rail for receiving the interior bottom portion of the mounting rail and bottom rear portion of the coil support member. The track may extend along the entire horizontal length of the support rail or may be segmented in one two or more sections. The track, providing structural support for distributing the weight of the heat exchanger along the horizontal length of an operably coupled mounting rail and support rail.

In addition to one or more of the features described above, or as an alternative, in further embodiments, at least two coil support members extend from the side of a first mounting rail to receive and to secure in place a first coil header, and at least two coil support members extend from the side of a second mounting rail, to receive and to secure in place a second coil header. The coil support members may be of any dimension or shape, including any shape that is complimentary to the shape of the coil headers. By way of example and not limitation, the coil support member is a fastener, including, without limitation, a curved or angular support or hook for holding or supporting a coil header. In addition to one or more of the features described above, or as an alternative, in further embodiments any number of coil support members may extend from any point along the length of a mounting rail, including but not limited to from the distal and proximal ends of a mounting rail. In another non-limiting embodiment, the mounting rail may have a single coil support member extending along all of or a portion of the length of a mounting rail, or in the alternative, may be segmented along the length of a mounting member, for receiving a coil header.

In addition to one or more of the features described above, or as an alternative, in further embodiments, at least one coil support member has a means for operably coupling said coil support member to at least one cross rail. By way of example and not limitation, a coil support member may have extending therefrom, a protruding connector for joining the coil support member to a void at a distal and proximal end of a cross rail. In one non-limiting embodiment, the void is one of a channel, notch, slit, groove or slit. It should be well understood that the cross rail, in an alternative and non-limiting embodiment, may have a protruding connector for joining to a coil support member void. The distal and proximal ends of each cross rail is shaped to conform to a coil header. By way of example and not limiting, the cross rail ends may be concave for receiving and securing a coil header to a heat exchanger assembly; however, it being understood that the shape of cross rail ends may be of any shape or dimension so as to conform to the shape of a coil header.

In addition to one or more of the features described above, or as an alternative, in further embodiments, the mounting rails, support rails and cross rails may be of any dimension, size or shape to achieve the purpose of mounting and securing a heat exchanger in a housing and for easy removal of the heat exchanger from the housing. By way of example, and not limitation, the dimensions of any of the rails may vary depending on a variety of factors, including but not limited to the size and weight of a heat exchanger to be mounted and supported, or the dimensions of a heat exchanger housing. By way of example and not limitation, the mounting rails and support rails may have similar dimension in terms of length, width or depth, but the cross rails may vary in length depending on the width across the heat exchanger coil headers.

According to another non-limiting embodiment, a frame for mounting a heat exchanger is provided having at least two mounting rails having a first mounting rail side, and a second mounting rail side, a proximate end and a distal end; a first coil support member extending from the first mounting rail side at the proximate end of the mounting rail; a second coil support member extending from the first mounting rail side at the distal end of the mounting rail; and a connection member located on the second mounting rail side. The frame for mounting a heat exchanger further including at least one support rail configured to engage the second mounting rail side of the at least two mounting rails; a first cross rail operably coupled to each of the first coil support members; and a second cross rail operably coupled to each of the second coil support members.

BRIEF DESCRIPTION OF THE DRAWINGS

The following descriptions should not be considered limiting in any way. With reference to the accompanying drawings, like elements are numbered alike.

The detailed description explains embodiments of the present disclosure, together with advantages and features, by way of example with reference to the drawings.

DETAILED DESCRIPTION

Figures 1A, 1B:
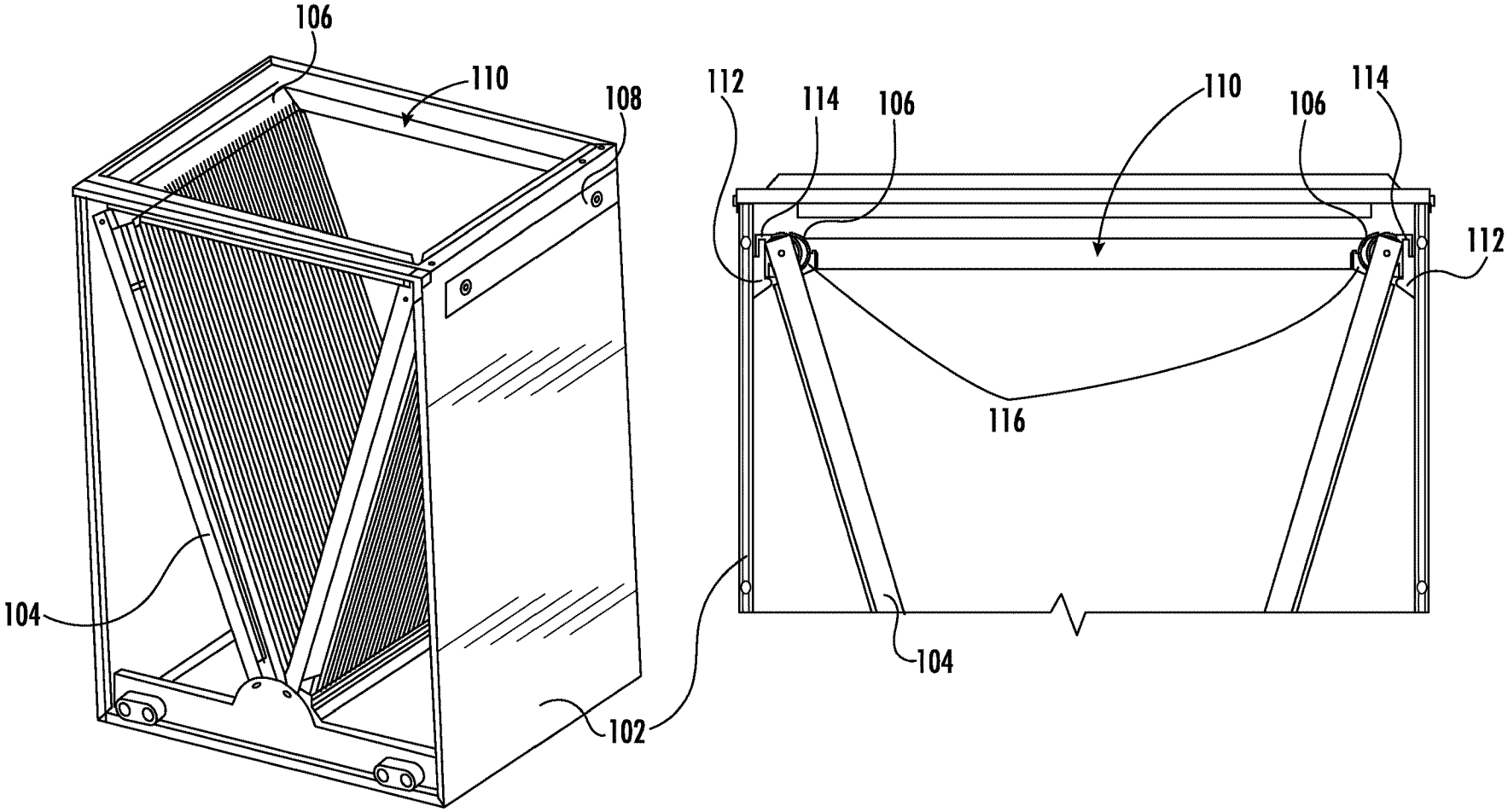
FIG. 1A is a perspective view of the heat exchanger assembly, in accordance with embodiments of the disclosure.
FIG. 1B is a side view of a portion of the heat exchanger assembly, in accordance with embodiments of the disclosure.

Referring now to FIG. 1A and FIG. 1B, a heat exchanger assembly 100 is schematically illustrated. The perspective view of FIG. 1A and side view of FIG. 1B show an exemplary heat exchanger 104 in a "V" configuration within a heat exchanger housing 102. An exemplary fastener assembly (FIG. 1A, 108) secures a support rail (FIG. 1B, 112) to the heat exchanger housing 102. The fastener assembly (FIG. 1A, 108) is duplicated on the side opposite to that which is illustrated here, but not shown. A mounting rail (FIG. 1B, 114) is operably coupled to a support rail (FIG. 1B, 112). At least one coil support member 116, extends from the mounting rail (FIG. 1B, 114) to receive and to secure in place, a coil header 106. The at least one coil support member 116 operably couples to at least one cross rail 110, said cross rail further securing the coil header (FIG. 1A, 106) within the frame 200.

Figure 2:
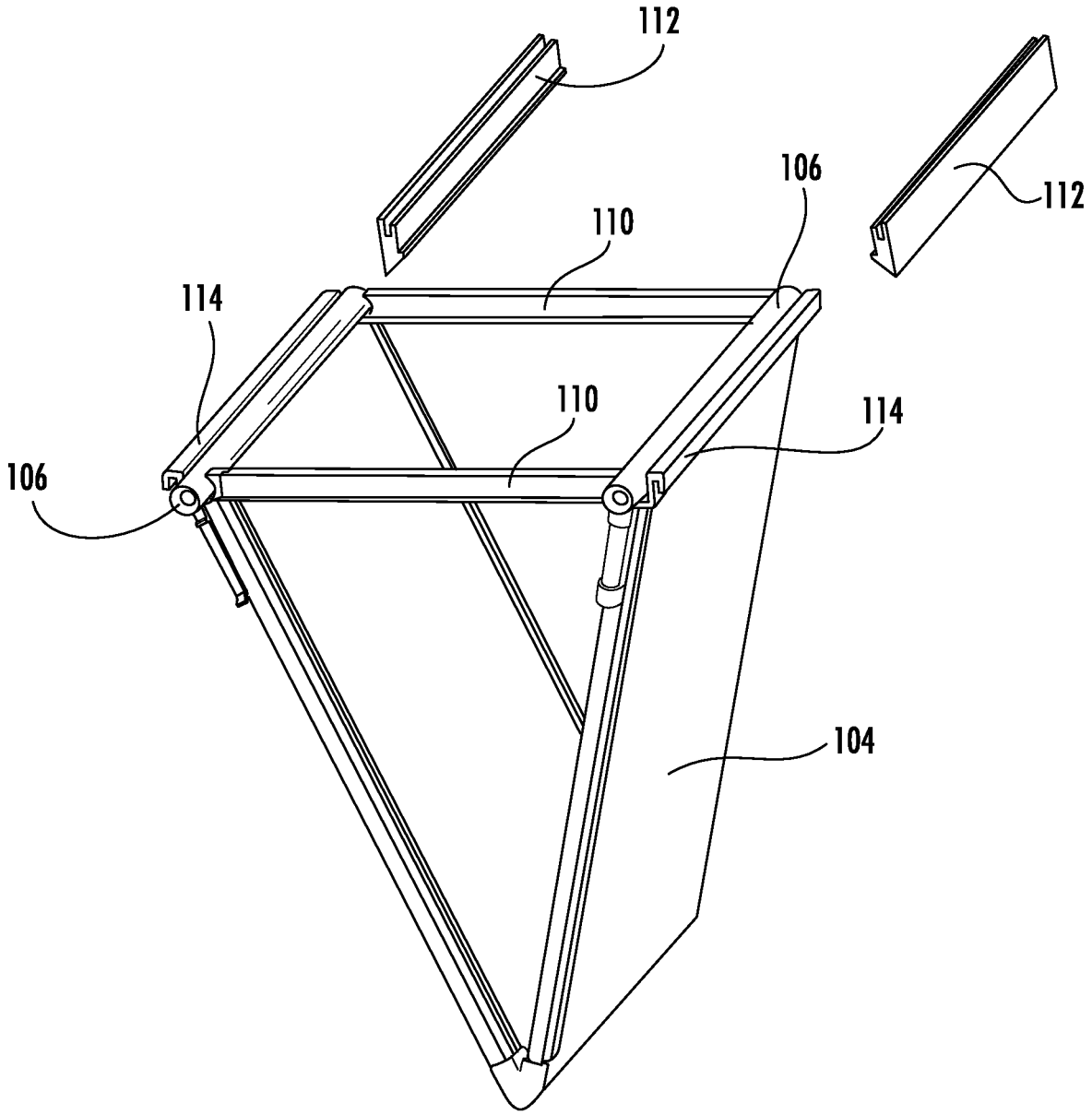
FIG. 2 is a perspective view of a portion of the heat exchanger assembly, in accordance with embodiments of the disclosure.

FIG. 2 illustrates the slidable feature of the heat exchanger assembly. Support rails 112 are fastened to a heat exchanger housing (not shown). The heat exchanger coils 106 are mounted and secured by the mounting rail 114, the coil supports (not shown) and cross rails (110).

Figure 3:
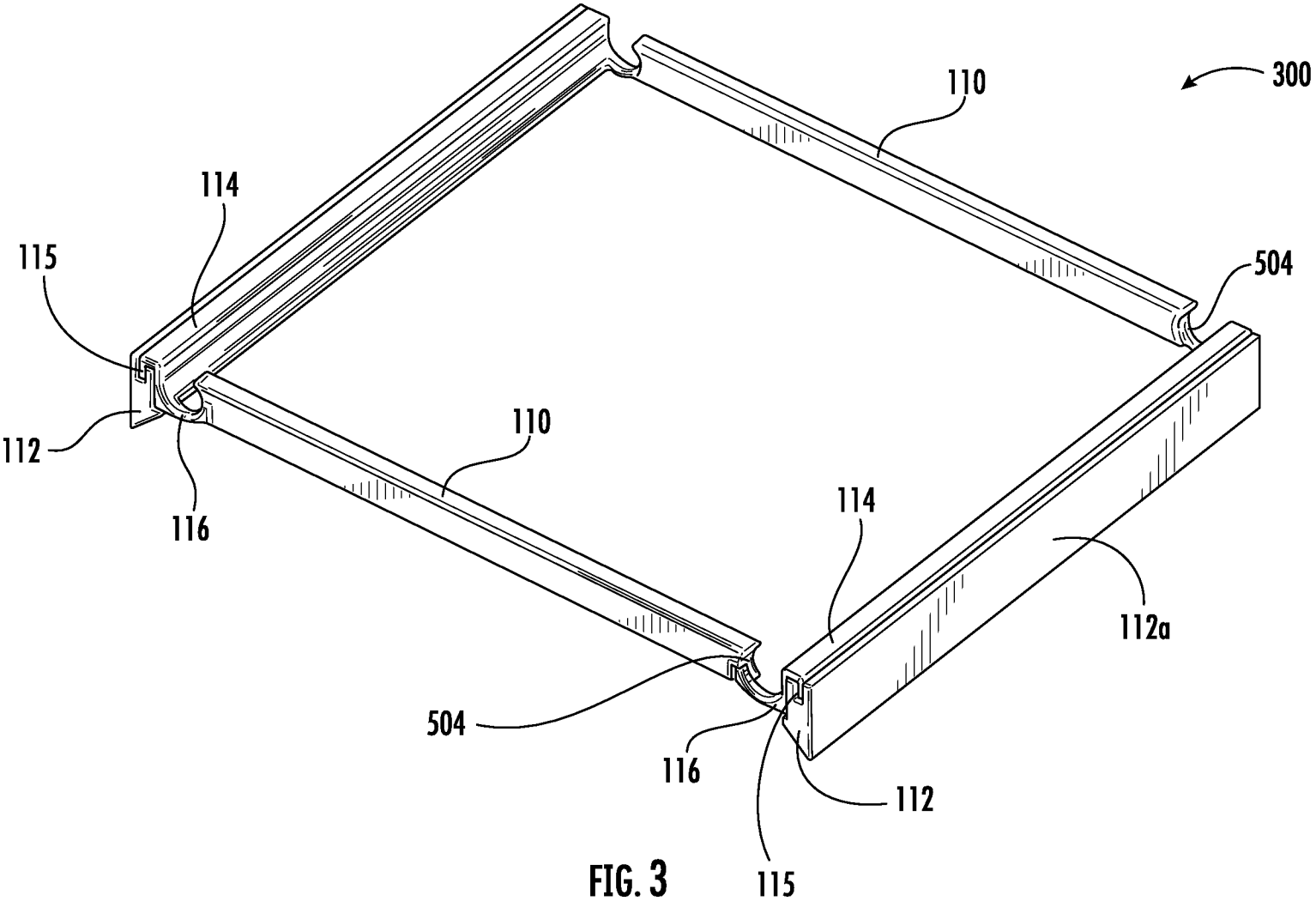
FIG. 3 is perspective view of a frame for mounting a heat exchanger, in accordance with embodiments of the disclosure.
Figure 4:
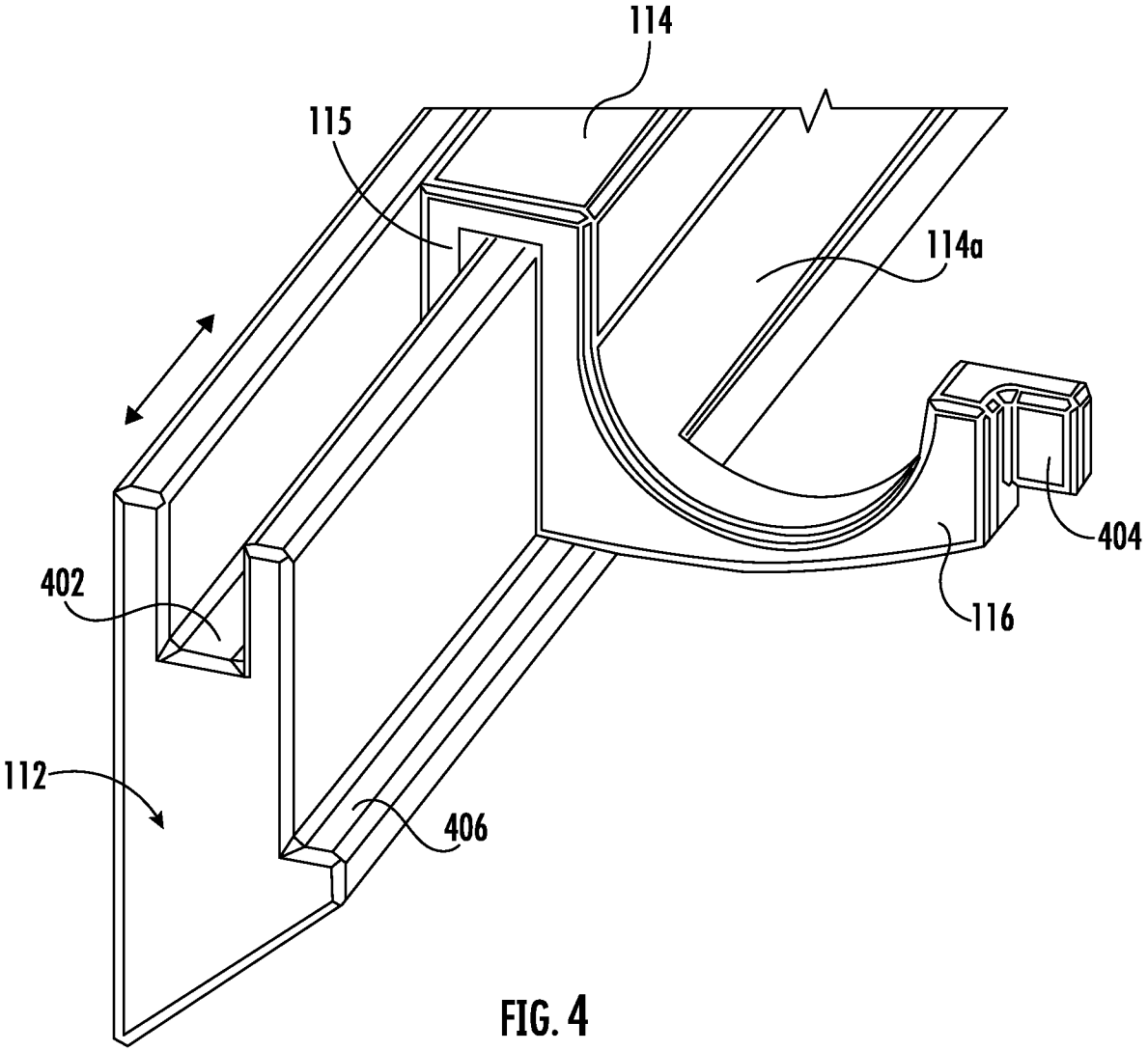
FIG. 4 is a perspective view of a portion of a frame for mounting a heat exchanger, in accordance with embodiments of the disclosure.

Turning to FIG. 3, a frame 300 for mounting a heat exchanger (FIG. 1A, 104) is shown. The frame 300 is secured to a heat exchanger housing (FIG. 1A, 102) by fastening at least two support rails 112 at two or more locations long the proximal length 112*a* of the support rails 112. At least two mounting rails 114 operably couple to the at least two support rails 112, the mounting rail 114, having a connector 115 that may slide or be inserted into a support rail 112 upwardly open channel (FIG. 4, 402). The at least two mounting rails 114 each have extending therefrom, at least two coil support members 116 that operably connect to at least two cross rails 110 joining the operably coupled support rails 112 and mounting rails 114.

Referring now to FIG. 4, a perspective view of a left front end of a frame (See, FIG. 3, 300) for mounting a heat exchanger is shown. An upwardly open channel 402, along the horizontal length of the support rail 112, is configured to receive a mounting rail 114 having a complimentary shape. As shown in FIG. 4, the connector 115 engages channel 402 while the mounting rail 114 slidably engages with the support rail 112 at structure 406 thereby allowing a heat exchanger (FIG. 6, 104) to be installed in or removed from a housing (not shown). The structure 406, may be a track, ledge or other means for guiding the mounting rail and provides structural support for the heat exchanger (not shown).

Figure 5:
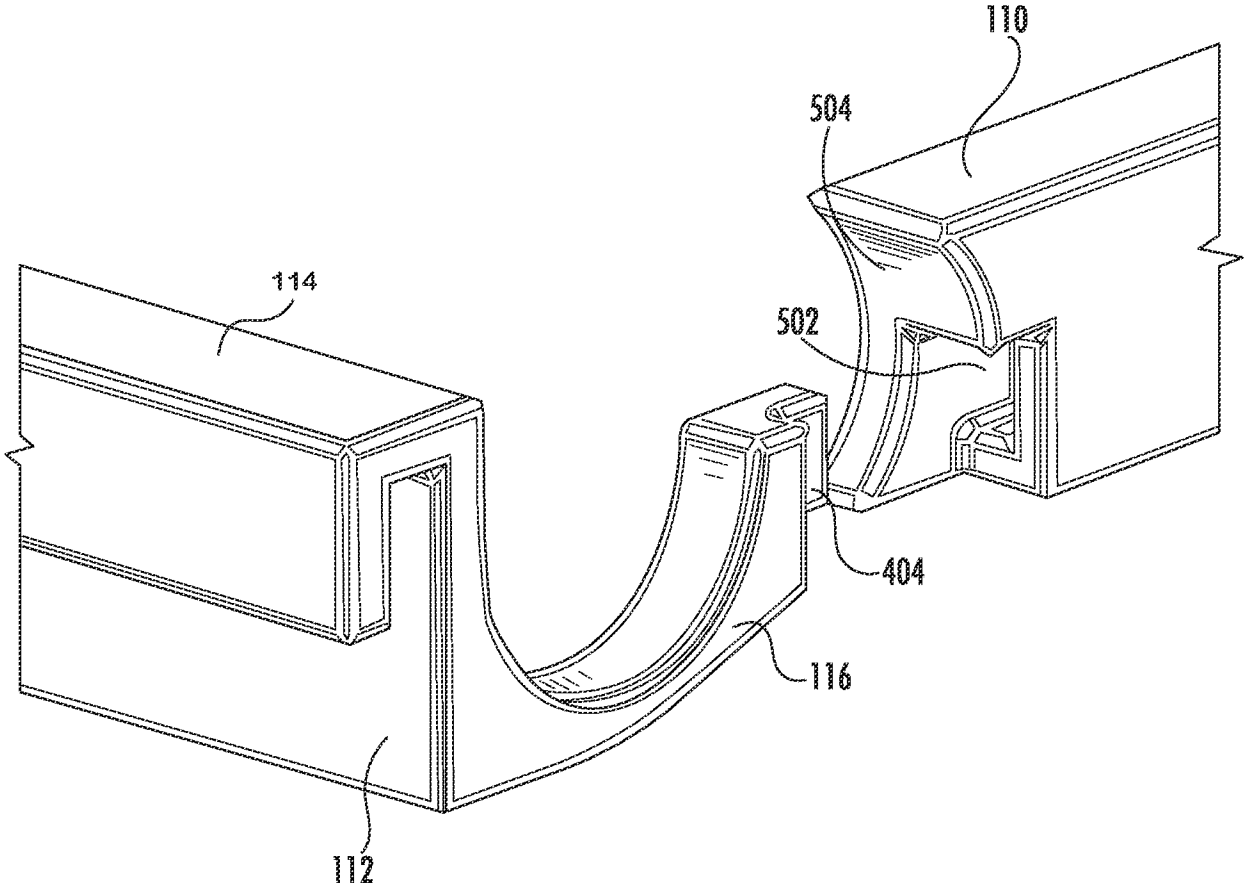
FIG. 5 is a perspective view of a portion of a frame for mounting a heat exchanger, in accordance with embodiments of the disclosure.

Turning to FIG. 5, a connector 404 extends from a coil support member 116. Connector 404 is configured to join the coil support member 116 to a cavity 502 within cross rail 110 as shown in FIG. 5. The distal and proximal ends of each cross rail 110 conforms to the shape of a coil header (not shown). By way of example and not limitation, a cross rail 110 having a substantially concave end 504 is shown, however, it being understood that that cross rail 110 end 504 may be of any complimentary shape for receiving and securing a coil header (FIG. 6, 106).

Figure 6:
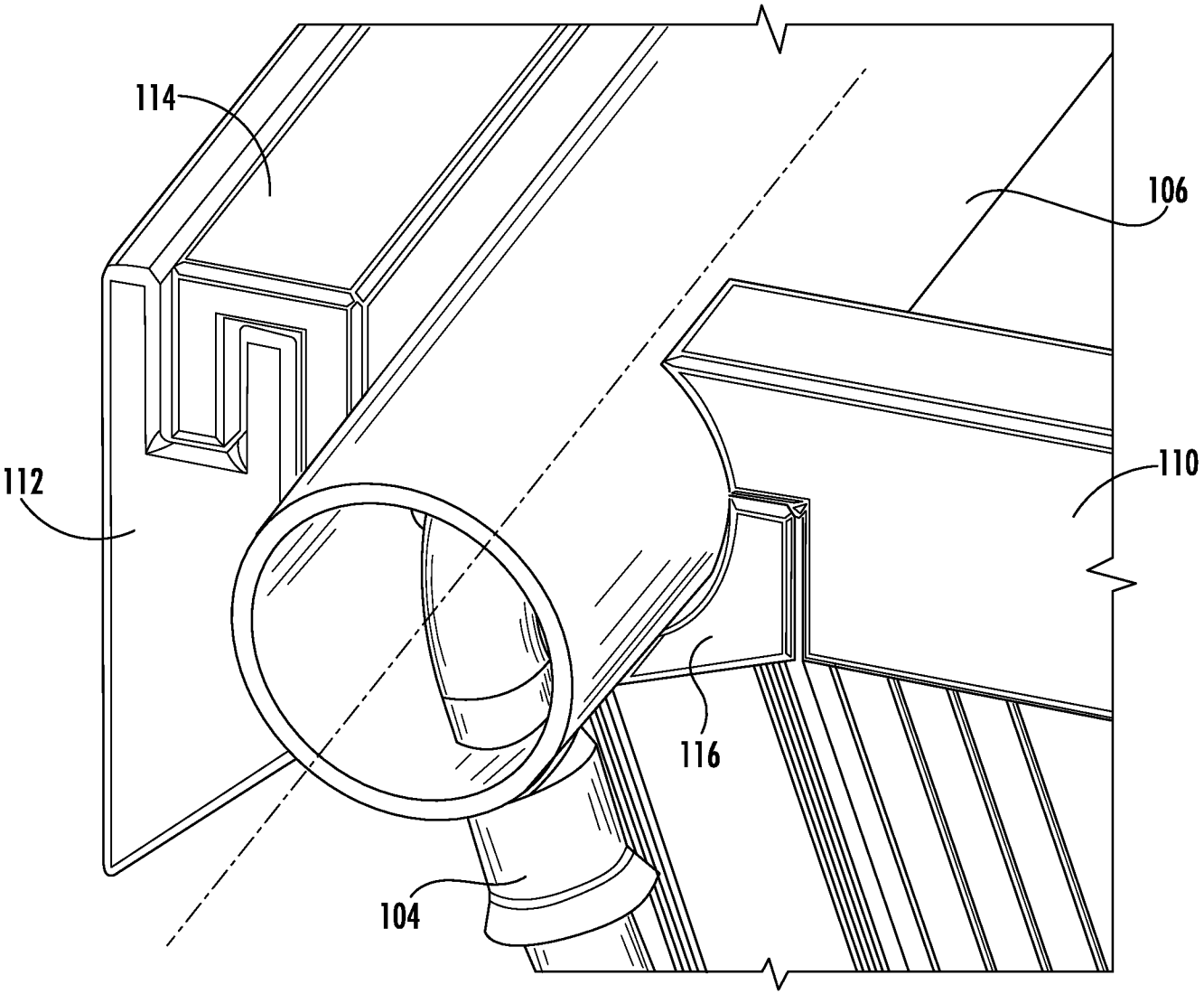
FIG. 6 is a perspective view of a portion of the heat exchanger assembly, in accordance with embodiments of the disclosure.

Turning to FIG. 6, mounting rail 114 operably couples with support rail 112. A coil support member 116 extends from said mounting rail 114 receiving a coil header 106 of a heat exchanger 104. A coil support member operably couples with a cross rail 110. The coil support member 116, cross rail 110 and mounting rail 114 secure the heat exchanger coil 106 to the frame (FIG. 3, 300) while also providing a means for easy removal of the heat exchanger 104 from the heat exchanger housing (FIG. 1A, 102), allowing the mounting rails (FIG. 2, 114) to slidably disengage from the support rails 112 as shown in FIG. 2.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

We claim:

1. A heat exchanger assembly, comprising:

a frame for mounting a heat exchanger operably coupled to at least two sides of a heat exchanger housing, said frame comprising:

at least two mounting rails, each mounting rail comprising:

a first mounting rail side, and a second mounting rail side, a first end and a second end distal from the first end; and at least two coil support members extending from the first mounting rail side; and at least one connection member located on the second mounting rail side; and at least one support rail configured to engage the second mounting rail side of the at least two mounting rails; and at least two cross rails operably coupled to each of the at least two coil support members; and the heat exchanger, comprising at least one coil header, wherein the at least one coil header is operably coupled to the at least two coil support members and to the at least two cross rails.

2. The assembly of claim 1, wherein at least one mounting rail of the at least two mounting rails and the at least one support rail, are movably adjustable.

3. The assembly of claim 1, wherein the at least one mounting rail of the at least two mounting rails and the at least one coil header form a seal preventing air bypass.

4. The assembly of claim 1, wherein one or more of the at least two mounting rails, the at least one support rail, or the at least two cross rails are constructed from a material having low thermal conductivity, including plastic.

5. The assembly of claim 1, wherein one or more of the at least two mounting rails, the at least one support rail, the at least two cross rails or the at least one coil header have a thermal barrier coating.

6. The assembly of claim 1, wherein the at least one support rail includes an upwardly open channel along its horizontal length for receiving a corresponding one of the at least two mounting rails.

7. The assembly of claim 1, wherein a first coil support member of the at least two coil support members extends from the first mounting rail side, of one of the at least two mounting rails, at the first end of the mounting rail, and a second coil support member of the at least two coil support members extends from the first mounting rail side, of one of the at least two mounting rails, at the second end of the mounting rail.

8. The assembly of claim 1, wherein the heat exchanger and frame are disposed in the heat exchanger housing.

9. A frame for mounting a heat exchanger, comprising:

at least two mounting rails, each mounting rail comprising:

a first mounting rail side, and a second mounting rail side, a first end and a second end distal from the first end;

a first coil support member extending from the first mounting rail side at the proximate end;

a second coil support member extending from the first mounting rail side at the distal end; and a connection member located on the second mounting rail side; and at least one support rail configured to engage the second mounting rail side of the at least two mounting rails;

a first cross rail operably coupled to each of the first coil support members; and a second cross rail operably coupled to each of the second coil support members.

10. The frame of claim 9, wherein the at least two mounting rails are movably adjustable.

11. The frame of claim 9, wherein the at least one support rail is movably adjustable.

12. The frame of claim 9, wherein one or more of the mounting rails, the at least one support rail, the first cross rail or the second cross rail are constructed of a non-heat conductive material.

13. The frame of claim 9, wherein the at least one support rail includes an upwardly open channel along its horizontal length for receiving a mounting rail of the at least two mounting rails.

14. The frame of claim 9, wherein the first mounting rail side of the at least two mounting rails further comprises at least one more coil support member in addition to the first coil support member and the second coil support member.

15. The frame of claim 9, wherein the first coil support member of the at least two mounting rails and the second coil support member of the at least two mounting rails are fasteners.

16. The frame of claim 15, wherein the first or the second support coil members of the at least two mounting rails is a hook for coupling the heat exchanger to the frame.

17. The frame of claim 15, wherein said first coil support member of the at least two mounting rails has a protruding connector for joining said first coil support member to a void at a first end of the first cross rail and a second end distal from the first end, said void being one of a channel, cavity, notch, slit, groove or slot.

18. The frame of claim 15, wherein said second coil support member of the at least two mounting rails has a protruding connector for joining said second coil support member to a void at a first end of the second cross rail and a second end distal from the first end, said void being one of a channel, cavity, notch, slit, groove or slot.

* * * * *